US006861602B2

(12) United States Patent
Juga

(10) Patent No.: US 6,861,602 B2
(45) Date of Patent: Mar. 1, 2005

(54) PUSH BUTTON AND METHOD FOR USE THEREOF

(75) Inventor: Douglas L. Juga, Kenosha, WI (US)

(73) Assignee: A.L. Hansen Manufacturing Co., Waukegan, IL (US)

( * ) Notice: Subject to any disclaimer, the term of this patent is extended or adjusted under 35 U.S.C. 154(b) by 0 days.

(21) Appl. No.: 10/352,609

(22) Filed: Jan. 27, 2003

(65) Prior Publication Data

US 2004/0144634 A1 Jul. 29, 2004

(51) Int. Cl.[7] ..... H01H 13/00
(52) U.S. Cl. ..... 200/341; 200/296
(58) Field of Search ..... 200/43.04, 43.07, 200/43.11, 43.13, 520, 293, 295, 302.1, 302.2, 341

(56) References Cited

U.S. PATENT DOCUMENTS

| | | | | | |
|---|---|---|---|---|---|
| 2,683,978 | A | | 7/1954 | Jacobi | 70/360 |
| 2,812,205 | A | | 11/1957 | Jakeway | 292/336.3 |
| 3,937,913 | A | * | 2/1976 | Soulas et al. | 200/302.2 |
| 4,272,974 | A | | 6/1981 | Hennessy | 70/129 |
| 4,489,577 | A | | 12/1984 | Crepinsek | 70/452 |
| 4,598,563 | A | | 7/1986 | Berkowitz | 70/492 |
| 4,689,456 | A | * | 8/1987 | Martin | 200/43.08 |
| 4,697,052 | A | * | 9/1987 | Ruaud | 200/43.07 |
| 4,698,466 | A | * | 10/1987 | Beck et al. | 200/61.78 |
| 4,742,198 | A | * | 5/1988 | Martin et al. | 200/296 |
| 4,755,641 | A | * | 7/1988 | Lutzenberger et al. | 200/526 |
| 5,435,159 | A | | 7/1995 | Ramsauer | 70/370 |
| 5,558,211 | A | * | 9/1996 | Heydner et al. | 200/553 |
| 5,586,459 | A | | 12/1996 | Bullock et al. | 70/224 |
| 5,679,936 | A | * | 10/1997 | Schaeffer et al. | 200/17 R |
| 5,689,980 | A | | 11/1997 | Weinerman et al. | 70/208 |
| 5,722,275 | A | | 3/1998 | Price et al. | 70/360 |
| 6,231,091 | B1 | | 5/2001 | Gleason et al. | 292/34 |
| D445,015 | S | | 7/2001 | Weinerman et al. | 178/302 |
| 6,483,057 | B1 | * | 11/2002 | Wu | 200/302.2 |

* cited by examiner

*Primary Examiner*—Michael A. Friedhofer
(74) *Attorney, Agent, or Firm*—Brinks Hofer Gilson & Lione

(57) ABSTRACT

A push button assembly includes a housing, a push button, a sealing member and a cover member. The push button is moveably received in the housing and is moveable between at least an extended, at-rest position and a depressed position. The sealing member is disposed on the push button and is moveable therewith between the at-rest and depressed positions. The cover member is releasably coupled to the housing. The sealing member engages the cover member when the push button and the sealing member are in the at-rest position, while the sealing member is spaced apart from the cover member when the push button and the sealing member are in the depressed position. A push button system and a method or operating a push button are also provided.

28 Claims, 3 Drawing Sheets

PUSH BUTTON AND METHOD FOR USE THEREOF

BACKGROUND

The present invention relates generally to a push button, and in particular, to a push button that is both durable and reconfigurable, and methods for the use thereof.

Often, as shown for example in U.S. Pat. No. 2,683,978 to Jacobi, push button latches are configured with a push button that moves through, rather than with, a sealing gasket, which prevents water and other foreign matter from entering into the interior of the push button. In such a configuration, the push button can turn, roll or otherwise wear upon the gasket, thereby reducing the sealing life of the gasket.

In addition, push button devices often are configured with an outer cover that is fixedly connected to or integrally formed With a housing. In such embodiments, the push button device cannot be customized for or by the end user. In addition, the device is not easily repairable if the outer cover becomes damaged. Accordingly, the need remains for an improved push button device that is both durable and easily reconfigurable.

SUMMARY

Briefly stated, in one preferred embodiment, a push button assembly includes a housing, a push button, a sealing member and a cover member. The push button is moveably received in the housing and is moveable between at least an extended, at-rest position and a depressed position. The sealing member is disposed on the push button and is moveable therewith between the at-rest and depressed positions. The cover member is releasably coupled to the housing. The sealing member engages the cover member when the push button and the sealing member are in the at-rest position, while the sealing member is spaced apart from the cover member when the push button and the sealing member are in the depressed position.

In another aspect, a push button system includes a housing, a push button and at least a first and second cover member. The push button is moveably received in the housing and is moveable between at least an extended, at-rest position and a depressed position. The first cover member has a first configuration and the second cover member has a second configuration, with the first configuration being different than the second configuration. Each of the first and second cover members are adapted to be releasably coupled to the housing. In various preferred embodiments, one or both of the first and second configurations can include a color, size or shape.

In yet another aspect, a method of operating a push button includes providing a housing, a push button moveably received in the housing, a sealing member disposed on the push button and moveable with the push button, and a cover member releasably coupled to the housing. The method further includes moving the push button and the sealing member between at least an extended, at-rest position and a depressed position, wherein the sealing member engages the cover member when the push button and the sealing member are in the at-rest position, and wherein the scaling member is spaced apart from the cover member when the push button and the sealing member are in the depressed position.

The presently preferred embodiments provide significant advantages over other push button devices and methods for the use thereof. In particular, the sealing member moves with the push button, rather than having the push button move relative thereto, which movement can tend to roll, turn and otherwise wear on the sealing member. In addition, the push button assembly can be easily reconfigured and customized.

In particular, the cover member can be easily removed and replaced with another cover member that has a different configuration. For example, the cover members can be made in a multitude of different shapes, sizes and colors, depending on the end user's application. In addition, if damaged, the cover member can be easily replaced, with an identical or different cover member. In this way, the other components of the push button assembly, including for example and without limitation the housing, lock cylinder, push button and adapter, can be preserved and/or recycled. Finally, the cover member and the housing hold or sandwich various components therebetween, thereby avoiding the need for an end screw and locking cam to hold the parts together. Accordingly, the end user can also customize the push button by incorporating a desired cam.

The foregoing paragraphs have been provided by way of general introduction, and are not intended to limit the scope of the following claims. The presently preferred embodiments, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
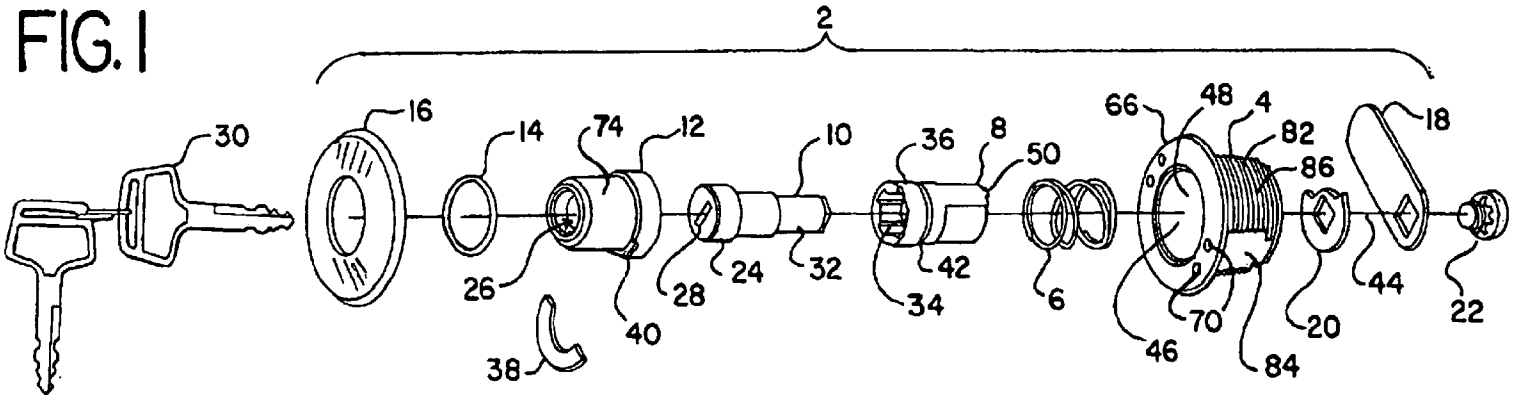
FIG. 1 is an exploded perspective view of a push button assembly.
Figure 2:
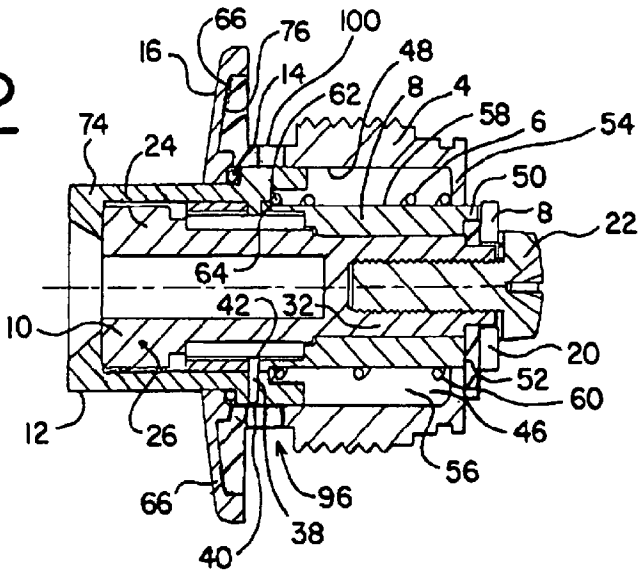
FIG. 2 is an enlarged side cross-sectional view of the push button assembly in an extended, at-rest position.

Referring to FIGS. 1 and 2, a push button assembly 2 is shown as including a housing 4, a spring 6, an adapter member 8, a lock cylinder 10, a push button 12, a sealing member 14 and a cover member 16. It should be understood that, in one alternative embodiment, the push button assembly can be configured without a lock cylinder. For example, a plug is shaped like the lock cylinder, but does not need a key. The push button assembly 2 can also be configured with a cam lock member 18 secured, for example with a screw 22, to the lock cylinder 10. A rotation washer 20 can be disposed between the cam lock member 18 and the lock cylinder 10 to limit the rotation of the lock cylinder and cam lock member. For example, in various preferred embodiments, the rotation washer limits the rotation of the cam lock member for example to 90° or 180° ranges of rotation in the clockwise or counter-clockwise direction, as shown for example in FIG. 6.

Referring again to FIGS. 1 and 2, to assemble the push button assembly 2, a first, key-receiving, end portion 24 of the lock cylinder is inserted into a cavity 26 formed in the push button 12. The key-receiving portion 24 has a key-receiving slot 28 shaped to receive a key 30. A second end portion 32 of the lock cylinder is received in a center bore 34 formed in the adapter member, with the end portion 32 matingly engaging the adapter member 8 so as to prevent relative rotation therebetween. In particular, tumblers engage slots formed in the adapter. The lock cylinder 10 can be configured as a conventional tumbler lock, which are well known in the art, and preferably is of automotive grade, with a torsion spring shutter. When the mating key 30 is inserted into the first end portion 24 through the slot 28, the lock cylinder can be rotated relative to the adapter member and housing.

The adapter member 8 includes a first end 36 that is received in the cavity 26 formed in the push button 12. A retainer member 38 extends through a recess 40 or passageway formed in the push button 12 and is received in a recess 42 formed in the adapter member 8. In this way, the adapter member 8 is secured to the push button 12 so as to prevent axial movement therebetween along axis 44, but permitting rotation of the push button relative to the adapter. In this way, the push button 12 is free to rotate relative to the adapter member 8, housing 4 and lock cylinder 10, which can provide enhanced security of the lock system by preventing an unintended rotation of the lock cylinder by virtue of a forced rotation of the push button.

The adapter member 8, lock cylinder 10 and push button 12 are inserted into a cavity 46 formed in the housing 4, with the spring 6 disposed around the adapter member 8. The retainer member 38 is trapped between the inner wall 48 of the housing and the adapter member 8. The adapter member 8 has a second end 50 that extends through an opening 52 formed in an end wall 54 of the housing 4.

The spring 6 is disposed in a recess 56 formed between the outer surface 58 of the adapter member and the inner surface of the inner wall 48 of the housing. A first end 60 of the spring is abutted against the end wall 54 of the housing defining the bottom of the cavity. A second end 62 of the spring is abutted against a shoulder 64 formed on each the push button 12 and adapter member 8 and biases those members away from the end wall 54 of the housing to a normal, at-rest position.

The cover member 16 is secured to an annular flange 66 of the housing over and around the push button 12, thereby trapping or sandwiching the push button 12, lock cylinder 10, adapter member 8 and spring 6 between the housing end wall 54 and the cover member 16. In this way, no additional members, such as the screw 22 or cam lock 18 are required to secure or retain those components in the housing.

Figure 10:
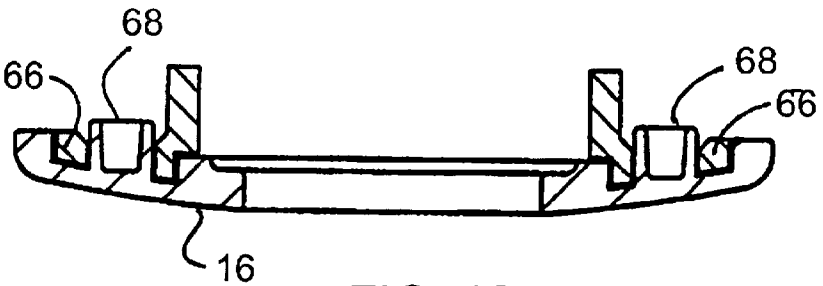
FIG. 10 is a cross-sectional view of alternative embodiment of a cover member.
Figure 8:
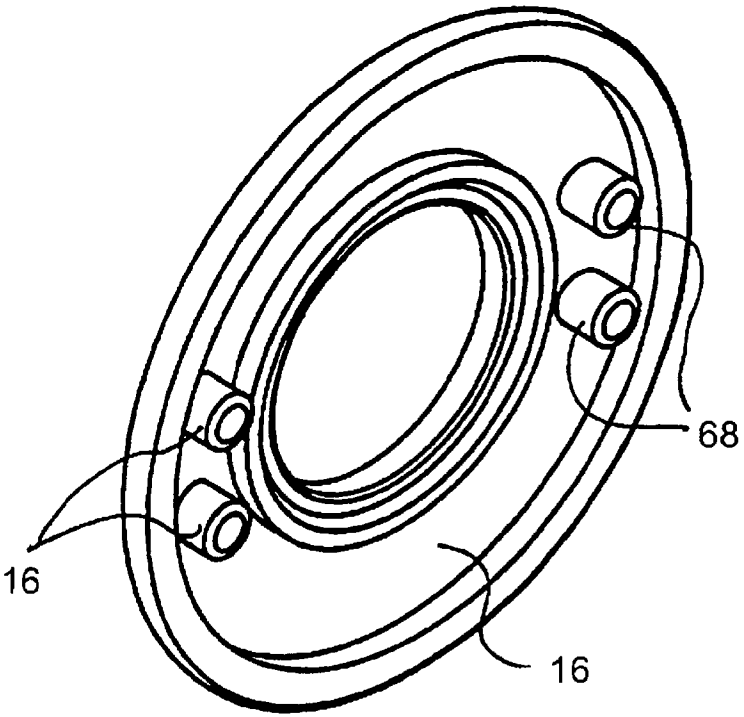
FIG. 8 is a rear perspective view of one embodiment of a cover member.

Preferably, the cover member 16 is releasably secured to the housing flange 66. For example, in one embodiment, the cover member 16 is provided with one or more deformable tabs 68 or protuberances. The tabs 68 can then be deformed, for example by bending or swaging, to releasably secure the cover member to the housing, for example by extending through openings 70 formed in the flange, or by extending around the flange. For example, as shown in FIGS. 8 and 10, the ends of a pair of cylindrical posts 68, which function as rivets and can be deformed to secure the cover to the housing. In other embodiments, the housing can include the deformable and/or resilient elements, which releasably engage the cover member.

Figure 9:
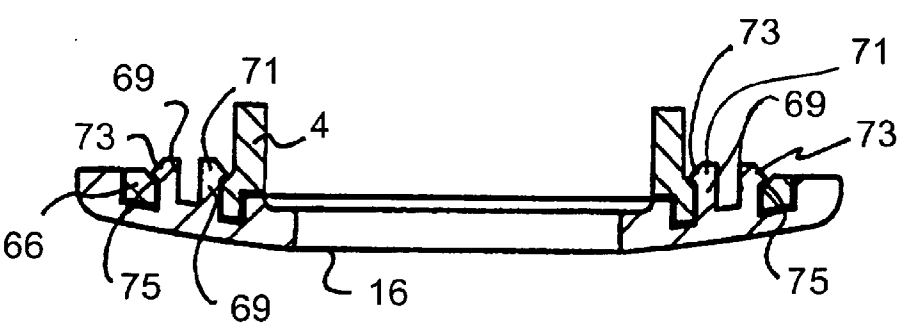
FIG. 9 is a cross-sectional view of one embodiment of a cover member.

In other embodiments, one or both of the cover member and housing may include retainer members, for example, resilient tab members or detents, that engage the other thereof with a snap fit. For example, as shown in FIG. 9, the posts include resilient tabs 69 having a head 71 defining a ramped surface 73 and a hook or engagement portion 75 on the end thereof. The tabs 69 are inserted through the openings 70 in the housing, with the ramped surface 73 biasing the tabs 69 inwardly until the head 71 clears the housing and the engagement portion 75 engages the housing with a snap fit.

In other embodiments, various mechanical fasteners, such as screws, hook and loop fasteners, etc., and/or releasable adhesives, can be used to releasably secure the cover member to the housing.

Referring to FIGS. 1 and 2, the sealing member 14 is disposed around an outer surface 74 of the push button. Preferably, the sealing member 14 engages the push button 12 with a friction fit, such that it moves therewith. Preferably, the sealing member 14 is made of rubber, and is formed for example as an o-ring. Preferably, the push button is chrome-plated, although it should be understood that it can be made of various metals, plastics and composites. The lock cylinder, adapter member and housing are preferably zinc plated, although it should be understood that they can be made from any number of suitable materials known in the art, including various metals, plastics and/or composites.

The cover member 16 can be easily replaced if damaged, or if it is desired to customize or reconfigure the push button device. In particular, the tab members 68, 69, or other retaining device, are simply deformed or otherwise acted on so as to allow them to be released from the housing 4. A replacement cover 16 can then be installed over the push button so as to again capture the components therein. In one preferred embodiment, a plurality of cover members, meaning two or more, can be provided with different configurations. The term "configuration" as used herein generally relates to the structure and/or appearance of an object, and includes without limitation, the shape, size, color, material, etc., alone and/or in combination, of that object.

If desired, the end user can customize the push button assembly 2 by installing a cover member 16 having a particular configuration. For example, the cover member can be configured as a particular trademark or logo, both by shape, size and/or color. In one embodiment, for example, the cover member can be configured to resemble a football. Of course, any number of different configurations can be provided. In one preferred embodiment, the cover member is made from a zinc die-cast material, with a black powder-coated finish. In other embodiments, the cover can be made of other plastics, metals, or composites and can be molded for example in a variety of different colors and shapes. The end user can also customize the push button assembly 2 or device by mounting their own, individualized, cam lock member 18 to the push button assembly.

In one embodiment, the push button assembly 2 is offered as a system or kit, wherein the end user is provided with a number of different cover members 16 having different configurations. Of course, it should be understood that a cover member 16 can be easily replaced with an identical cover member if damaged, without having to dispose of the remaining push button components. In addition, a kit can be provided with a plurality of identical cover members 16. Similarly, the system can be provided with a number of different housing retaining members 88, 90, 92 having different configurations and a different cam lock member 18 having different configurations to suit various end uses.

Figure 5:
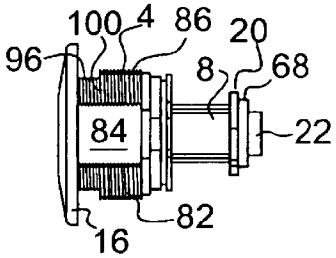
FIG. 5 is a side view of the push button in a depressed position.
Figure 4:
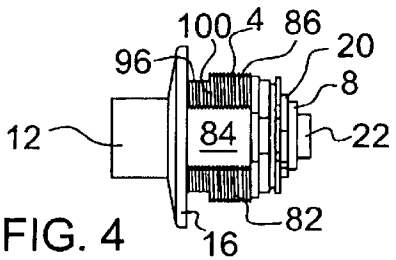
FIG. 4 is a side view of the push button in an extended, at-rest position.
Figure 6:
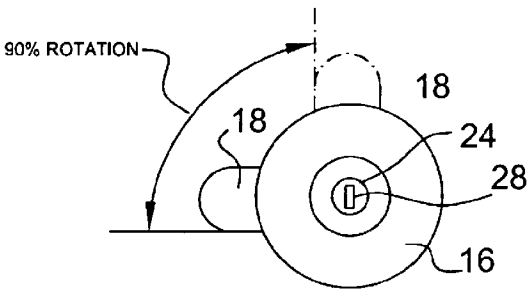
FIG. 6 is a front view of the push button.

In operation, and referring to FIGS. 4–6, the user inserts the key 30 into through the slot 28 and into the lock cylinder 10 and rotates the key 30 to move the cam lock member 18 out of locking engagement with a corresponding latch mechanism (not shown). For example, in one preferred embodiment, shown in FIG. 6, the cam lock member 18 is moved 90 degrees from a locked to an unlocked position. Referring to FIGS. 4 and 5, the user then pushes the push button 12 against the biasing force of the spring 6 from the extended, at-rest position to the depressed position so as to disengage the latch mechanism. Various latch mechanisms are well known in the art. One suitable latch echanism is the 450 Rotary Latch available from A.L. Hansen Manufacturing, the assignee of the present application. Alternatively, the lock cylinder can be omitted, and the user simply pushes the push button from the extended position to the depressed position to disengage the latch mechanism.

After the latch mechanism is disengaged, the user releases the push button 12, and the spring 6 biases the push button 12 from the depressed position to the extended, at-rest position. As the push button 12 moves relative to the housing in either direction along the axis 44, the sealing member 14 moves therewith between the extended and depressed positions. In the extended position, the sealing member 14 sealingly engages an inner surface 76 of the cover member 16, and in particular an annular recess or shoulder formed therein, to prevent water and other foreign substances from entering the interior of the push button assembly. In the depressed position, the sealing member 14 moves away from the cover member 16, and is spaced apart therefrom, as the sealing member 14 moves with the push button 12 from the extended to the depressed position.

Figure 3:
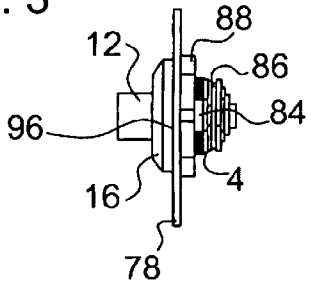
FIG. 3 is a side view of the push button mounted on a panel member.
Figure 7:
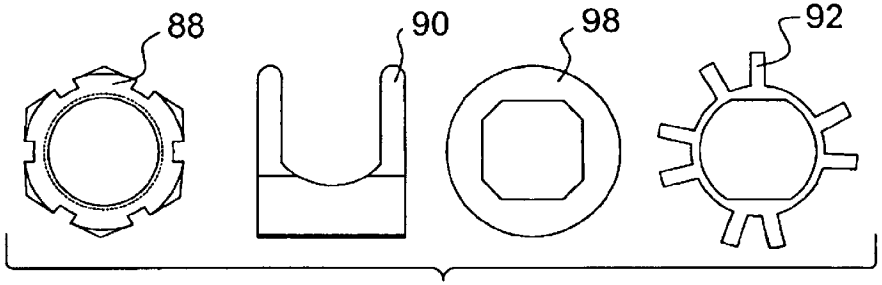
FIG. 7 illustrates a plurality of housing retainer members.

Referring to FIGS. 3 and 7, the housing 4 is preferably mounted to a panel member 78, such as a door or wall. In one embodiment, the housing includes an annular recess 96 formed around a first cylindrical portion 100, which is shaped and dimensioned to be inserted through an opening in the panel 78. The housing further includes a second cylindrical portion 82 having an outer threaded surface 86. The cylindrical portions 100 and 82 are inserted through the opening formed in the panel member 78.

In a preferred embodiment, the housing 4 includes a key surface 84, formed for example as one or more flat spots, such that the housing 4 mates with the opening formed in the panel member 78 in a non-rotatable relationship, wherein the opening has corresponding flat, or linear edges. A housing retainer member, such as a nut 88, is then threaded onto the cylindrical portion and clamps the panel member 78 and gasket 98 between the nut 88 and the annular flange 66 of the housing. Alternatively, a spring clip 90 can be slid laterally into engagement with a slot or groove formed in the housing 4 at recess 96 to secure the housing to the panel member. In yet another embodiment, a locking ring 92, which has deformable flanges 94, can be used to secure the nut 88 and prevent it from loosening. Preferably, the gasket 98 is disposed between the housing flange 66 and the panel member 78. Of course it should be understood that the housing can be secured to the panel member in any number of ways, for example and without limitation welding or fasteners, or can be integrally formed therewith.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A push button assembly comprising:

a housing comprising a retainer portion;

a push button moveably received in said housing, wherein said push button is axially moveable between at least an extended, at-rest position and a depressed position along a longitudinal axis;

a sealing member disposed on said push button and moveable with said push button between said at-rest and depressed positions along said longitudinal axis;

a cover member releasably coupled to said housing, wherein said sealing member engages said cover member when said push button and said sealing member are in said at-rest position, and wherein said sealing member is spaced apart from said cover member when said push button and said sealing member are in said depressed position; and a panel member having an opening and defining an inside and outside, wherein at least a portion of said housing extends through said opening and is disposed on said inside of said panel member, and wherein said retainer portion of said housing and said cover member are disposed on said outside of said panel member.

2. The push button assembly of claim 1 further comprising a spring biasing said push button to said at-rest position.

3. The push button assembly of claim 2 wherein said spring is disposed between said push button and said housing.

4. The push button assembly of claim 1 further comprising a lock cylinder disposed in said push button.

5. The push button assembly of claim 4 further comprising an adapter member disposed in said push button, and wherein said lock cylinder is disposed in said adapter member.

6. The push button assembly of claim 5 further comprising a retainer securing said adapter member to said push button.

7. The push button assembly of claim 6 wherein said push button is rotatably mounted to said adapter with said retainer, and wherein said push button is rotatable relative to said adapter about said longitudinal axis.

8. The push button assembly of claim 1 wherein said cover member is releasably coupled to said housing with a snap fit.

9. The push button assembly of claim 1 wherein one of said cover member and said housing comprise at least one deformable tab releasably engaging the other of said cover member and said housing.

10. A push button system comprising:

a housing;

a push button moveably received in said housing, wherein said push button is moveable between at least an extended, at-rest position and a depressed position, wherein said push button and said housing have a single assembled configuration; and at least a first and second cover member, wherein said first cover member has a first configuration and said second cover member has a second configuration, wherein said first configuration is different than said second configuration, and wherein said at least said first and second cover members are each adapted to be releasably coupled to said housing forming said single assembled configuration with said push button.

11. The system of claim 10 wherein at least one of said first and second configurations comprises a color.

12. The system of claim 10 wherein at least one of said first and second configurations comprises a shape.

13. The system of claim 10 wherein at least one of said first and second configurations comprises a size.

14. The system of claim 10 further comprising a sealing member disposed on said push button and moveable with said push button between said at-rest and depressed positions, and wherein said sealing member is adapted to engage one of said at least said first and second cover members when said push button and said sealing member are in said at-rest position and when said one of said at least said first and second cover members is releasably coupled to said housing, and wherein said sealing member is adapted to be spaced apart from said one of said at least said first and second cover members when said push button and said sealing member are in said depressed position and when said one of said at least said first and second cover members is releasably coupled to said housing.

15. The push button system of claim 10 wherein said housing comprises a retainer portion, and further comprising a panel member having an opening and defining an inside and outside, wherein at least a portion of said housing extends through said opening and is disposed on said inside of said panel member, and wherein said retainer portion of said housing is disposed on said outside of said panel member.

16. A method of operating a push button comprising:

providing a housing comprising a retainer portion, a push button moveably received in said housing, a sealing member disposed on said push button and moveable with said push button, and a cover member releasably coupled to said housing, and a panel member having an opening and defining an inside and outside, wherein at least a portion of said housing extends through said opening and is disposed on said inside of said panel member, and wherein said retainer portion of said housing and said cover member are disposed on said outside of said panel member; and moving said push button and said sealing member along a longitudinal axis between at least an extended, at-rest position and a depressed position wherein said sealing member engages said cover member when said push button and said sealing member are in said at-rest position, and wherein said sealing member is spaced apart from said cover member when said push button and said sealing member are in said depressed position.

17. The method of claim 16 further comprising biasing said push button to said at-rest position with a spring.

18. The method of claim 17 wherein said spring is disposed between said push button and said housing.

19. The method of claim 16 further comprising providing a lock cylinder disposed in said push button.

20. The method of claim 19 further comprising providing an adapter member disposed in said push button, and wherein said lock cylinder is disposed in said adapter member.

21. The method of claim 20 further comprising providing a retainer securing said adapter member to said push button.

22. The method of claim 16 wherein said cover member is releasably coupled to said housing with a snap fit.

23. The method of claim 16 wherein one of said cover member and said housing comprises at least one deformable tab releasably engaging the other of said housing and said cover member.

24. The method of claim 16 wherein said cover member comprises a first cover member, and further comprising releasing said first cover member from said housing and releasably coupling a second cover member to said housing.

25. The method of claim 24 wherein said first and second cover members have a different configuration.

26. A push button assembly comprising:

a housing;

a push button moveably received in said housing, wherein said push button is axially moveable along a longitudinal axis between at least an extended, at-rest position and a depressed position;

an adapter member, wherein said push button is rotatably connected to said adapter member;

a lock cylinder disposed in said adapter member, said lock cylinder configurable between an unlocked configuration when engaged by a key and a locked configuration when disengaged from said key, wherein said lock cylinder is rotatable relative to said adapter member when in said unlocked configuration, and wherein said lock cylinder is non-rotatable relative to said adapter member when in said locked configuration; and wherein said push button is rotatable relative to said adapter member and said lock cylinder about said longitudinal axis, but wherein said push button is fixed relative to said adapter member and said lock cylinder in an axial direction.

27. The push button assembly of claim 26 further comprising a retainer rotatably connecting said push button to said adapter member, wherein said retainer restricts movement between said adapter member and said push button in an axial direction but allows rotation of said push button relative to said adapter about said longitudinal axis.

28. The push button assembly of claim 26 further comprising a sealing member disposed on said push button and moveable with said push button between said at-rest and depressed positions along said longitudinal axis, and a cover member releasably coupled to said housing, wherein said sealing member engages said cover member when said push button and said sealing member are in said at-rest position, and wherein said sealing member is spaced apart from said cover member when said push button and said sealing member are in said depressed position.

* * * * *